US006142736A

United States Patent [19]

Arbeus

[11] Patent Number: 6,142,736

[45] Date of Patent: Nov. 7, 2000

[54] PUMP IMPELLER

[75] Inventor: Ulf Arbeus, Lidingo, Sweden

[73] Assignee: ITT Manufacturing Enterprises, Inc., Wilmington, Del.

[21] Appl. No.: 09/168,514

[22] Filed: Oct. 8, 1998

[30] Foreign Application Priority Data

Nov. 18, 1997 [SE] Sweden ..... 9704222

[51] Int. Cl.[7] ..... F04D 29/38

[52] U.S. Cl. ..... 416/185; 416/188; 416/223 B; 416/DIG. 2; 415/72

[58] Field of Search ..... 415/71, 72; 416/223 R, 416/223 B, 188, 185, 186 R, 176, 238, DIG. 2

[56] References Cited

U.S. PATENT DOCUMENTS

| | | | |
|---|---|---|---|
| 3,644,056 | 2/1972 | Wiselius | 415/72 |
| 3,782,851 | 1/1974 | Hackbarth et al. | 416/186 R |
| 4,676,718 | 6/1987 | Sarvanne | 416/185 |
| 5,256,032 | 10/1993 | Dorsch | 415/121.1 |
| 5,749,707 | 5/1998 | Nomoto | 416/223 B |

*Primary Examiner*—Edward K. Look
*Assistant Examiner*—Richard Woo
*Attorney, Agent, or Firm*—Menotti J. Lombardi

[57] ABSTRACT

A pump impeller of a centrifugal- or a half axial type meant to pump liquids, mainly sewage water, the pump impeller including a hub provided with one or several vanes, the leading edges of which being strongly swept backwards. The size of the sweep angle ($\alpha$) varies between 40 and 55 degrees at the connection with the hub, and 60 and 75 degrees at the periphery.

4 Claims, 3 Drawing Sheets

PUMP IMPELLER

FIELD OF THE INVENTION

The invention concerns a pump impeller and more precisely a pump impeller for centrifugal-or half axial pumps for pumping of fluids, mainly sewage water.

BACKGROUND OF THE INVENTION

In literature there are lot of types of pumps and pump impellers for this purpose described, all however having certain disadvantages. Above all this concerns problems with clogging and low efficiency.

Sewage water contains a lot of different types of pollutants, the amount and structure of which depend on the season and type of area from which the water emanates. In cities plastic material, hygiene articles, textile etc are common, while industrial areas may produce wearing particles. Experience shows that the worst problems are rags and the like which stick to the leading edges of the vanes and become wound around the impeller hub. Such incidents cause frequent service intervals and a reduced efficiency.

In agriculture and pulp industry different kinds of special pumps are used, which should manage straw, grass, leaves and other types of organic material. For this purpose the leading edges of the vanes are swept backwards in order to cause the pollutants to be fed outwards to the periphery instead of getting stuck to the edges. Different types of disintegration means are often used for cutting the material and making the flow more easy. Examples are shown in SE-435 952, SE-375 831 and U.S. Pat. No. 4,347,035.

As pollutants in sewage water are of other types more difficult to master and as the operation times for sewage water pumps normally are much longer, the above mentioned special pumps do not fullfil the requirements when pumping sewage water, neither from a reliability nor from an efficiency point of view.

A sewage water pump quite often operates up to 12 hours a day which means that the energy consumption depends a lot on the total efficiency of the pump.

Tests have proven that it is possible to improve efficiency by up to 50% for a sewage pump according to the invention as compared with known sewage pumps. As the life cycle cost for an electrically driven pump normally is totally dominated by the energy cost (c:a 80%), it is evident that such a dramatic increase will be extremely important.

In literature the designs of the pump impellers are described very generally, especially as regards the sweep of the leading edges. An unambigous definition of said sweep does not exist.

Tests have shown that the design of the sweep angle distribution on the leading edges is very important in order to obtain the necessary self cleaning ability of the pump impeller. The nature of the pollutants also calls for different sweep angles in order to provide a good function.

Literature does not give any information about what is needed in order to obtain a gliding, transport, of pollutants outwards in a radial direction along the leading edges of the vanes. What is mentioned is in general that the edges shall be obtuse-angled, swept backwards etc. See SE-435 952.

When smaller pollutantans such as grass and other organic material are pumped, relatively small angles may be sufficient in order to obtain the radial transport and also to disintegrate the pollutants in the slot between pump impeller and the surrounding housing. In practice disintegration is obtained by the particles being cut through contact with the impeller and the housing when the former rotates having a periphery velocity of 10 to 25 m/s. This cutting process is improved by the surfaces being provided with cutting devices, slots or the like. Compare SE-435 952. Such pumps are used for transport of pulp, manure etc.

When designing a pump impeller having vane leading edges swept backwards in order to obtain a self cleaning, a conflict arises between the distribution of the sweep angle, performance and other design parameters. In general it is true that an increased sweep angle means a less risk for clogging, but at the same time the efficiency decreases.

SUMMARY OF THE INVENTION

The invention brings about a possibility to design the leading edge of the vane in an optimum way as regards obtaining of the different functions and qualities for reliable and economic pumping of sewage water containing pollutants such as rags, fibres etc.

The invention contains in principle three components which are presented in the claims.

The first component, shown in FIG. 5, quantifies a band of the sweep angle distribution which admits a good function and efficiency. The range is connected to size, periphery velocity and material friction. The independant variable that is used to describe this, here called normalized radius, is defined as follows:

$$\text{Normalized radius}=(r-r_1)/(r_2-r_1) \qquad \text{Equation 1}$$

Where $r_1$ is the radius of the hub connection, $r_2$ the radius out to the periphery of the leading edge and where the radius according to a cylinder coordinate system having origo in the center of the impeller shaft, defines the shortest distance between the actual point and a point on the extension of the impeller shaft.

The basics in this part of the invention being that the sweep angle of the leading edge is increased considerably outwards, from a minimum of 40 degrees at the hub connection to a minimum of 55 degrees at the periphery. The upper limit, 60–75 degrees, defines a boarder line above which the efficiency as well as the reliability are influenced in a negative way.

The second part of the invention concerns a special embodiment which has the very advantagous ability that the sweep angle will be almost independant of the operation point, i. e. different flows and heads, which also corresponds with different velocity triangles ($\overline{C}$, $\overline{U}$, $\overline{W}$).

The definition of the sweep angle will be described below with reference to the enclosed drawings.

DETAILED DESCRIPTION OF THE INVENTION

Figure 1:
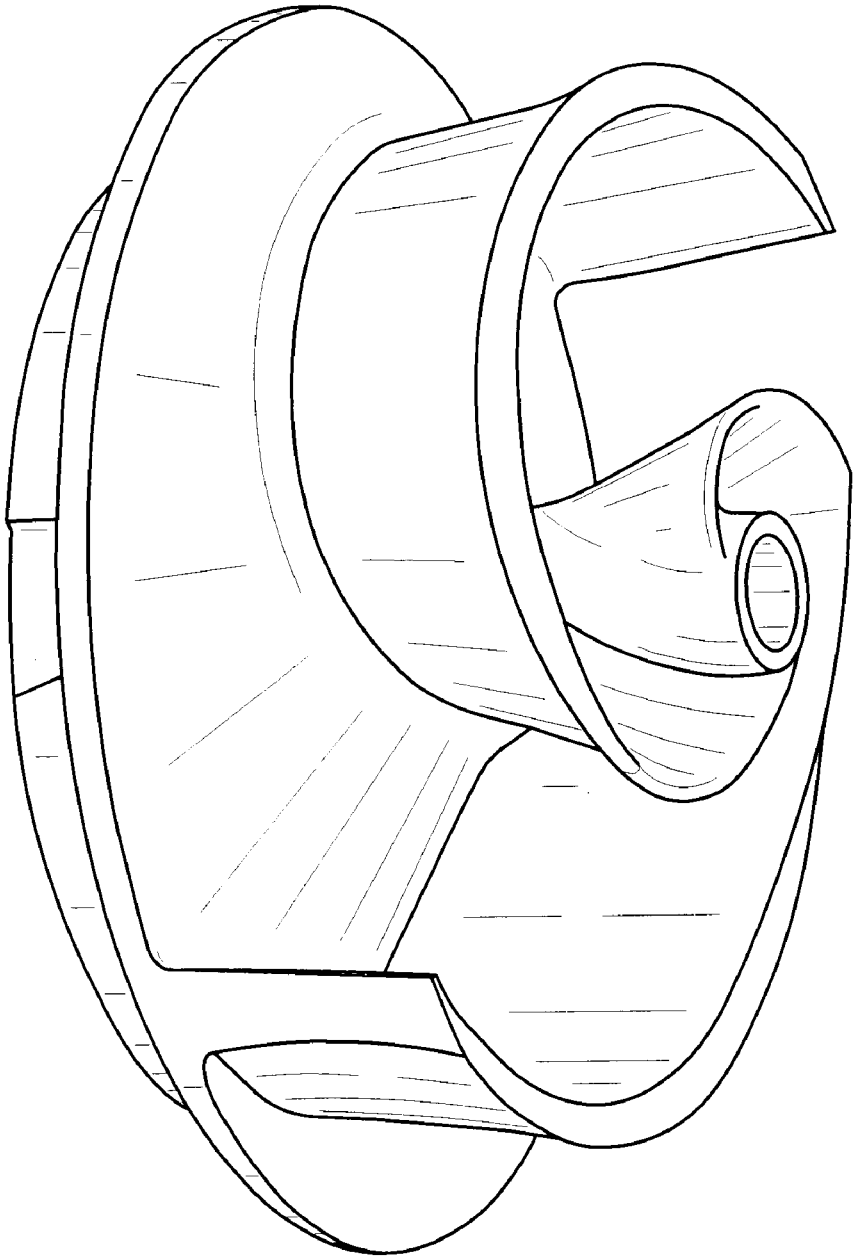
FIG. 1 shows a three dimensional view of a pump impeller according to the invention.

In the drawings 1 stands for an impeller hub, 2 a vane having a leading edge 3. 4 stands for the connection of the leading edge to the hub and 5 the periphery of the edge. 6 stands for the normal to the edge in a certain point. 7 stands for the wall of the pump housing, 8 the end of the hub, 9 the direction of rotation, $\alpha$ sweep angle, $W_R$ the projected relative velocity, the velocity of the fluid in a co-rotating coordinate system, and z the impeller shaft direction.

Figure 2:
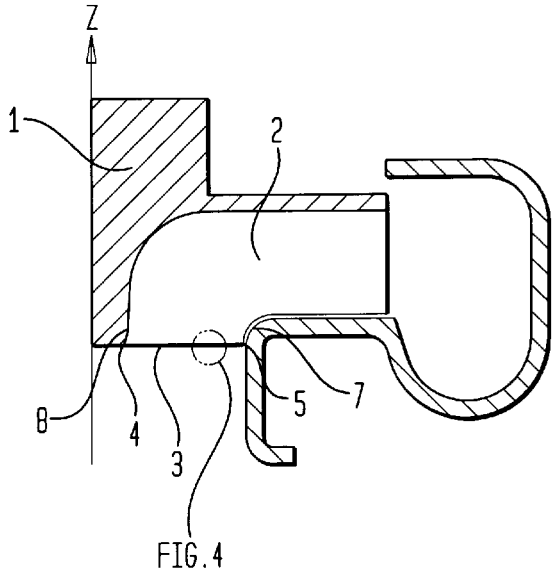
FIG. 2 shows a radial cut through a schematically drawn pump according to the invention.
Figure 3:
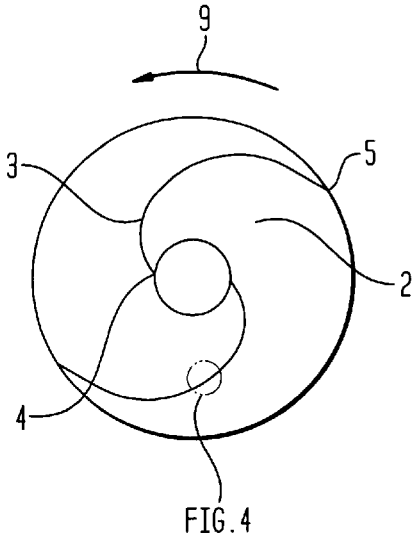
FIG. 3 shows a schematic axial view of the inlet of the impeller.
Figure 4:
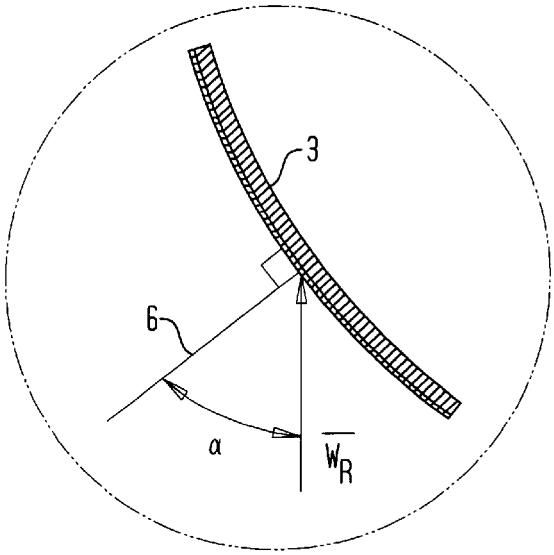
FIG. 4 shows an enlargement of an area on the leading edge of an impeller vane.
Figure 5:
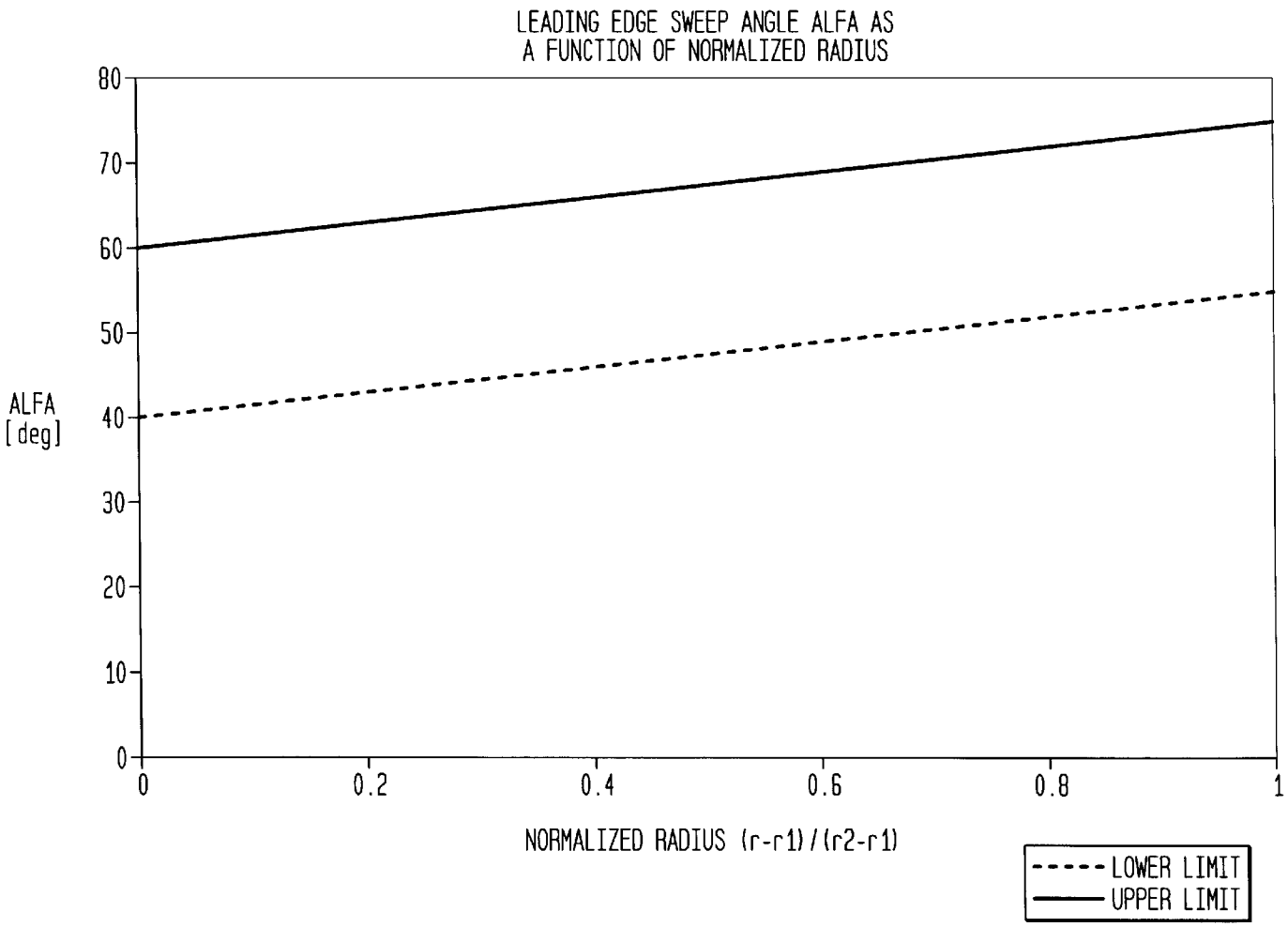
FIG. 5 is a diagram showing the relation between the back sweep of the leading edge and a standard radius according to the invention.

In order to design a desired pump impeller geometry in an optimum way, a correct definition of said sweep angle is a provision. The exact sweep angle $\alpha$ is in general a function of the geometry of the leading edge in a meridional view (r–z) as well as in an axial view (r–θ), see FIGS. 2 and 3.

The exact definition will be a function of the curve that describes the form of the leading edge 3 and the local relative velocity $\overline{W}$ at that curve. This can be mathematically stated in the following way:

With traditional designations of the velocity triangle ($\overline{C}$, $\overline{U}$, $\overline{W}$) the relative velocity $\overline{W}(r)$ is a function of the position vector $\bar{r}$ in a co-rotating cylindric coordinate system. In the normal way the relative velocity $\overline{W}(r,\theta,z)$ can also be explained in its components ($W_r$, $W_\theta$, $W_Z$).

The three dimensional curve along the leading edge 3 can in a corresponding co-rotating coordinate system be described as a function $\overline{R}$ which depends on the position vector $\bar{r}$, i.e. $\overline{R}=\overline{R}(r, \theta, z)$.

An infinitesimal vector which is in parallel with the leading edge in every point can be defined as $d\overline{R}$. From the definition of scalar product an expression is obtained for the sweep angle $\alpha$, defined as the angle between the normal to $d\overline{R}$ and $\overline{W}_R$, where $\overline{W}_R$, the projected relative velocity, is defined as the orthogonal projection of $\overline{W}_R$ onto the direction of $\overline{W}$ at zero incidence. This means that $\overline{W}_R$ and $\overline{W}$ are equal at or close to the nominal operating point, sometimes referred to the best efficiency point.

$$\alpha=\pi/2-\arccos[(d\overline{R}\cdot\overline{W}_R)/(|d\overline{R}|\cdot|\overline{W}_R|)] \qquad \text{Equation 2}$$

If it is assumed that the absolute inlet velocity does not have any circumferencial component which is normal, $W_\theta$ equals the peripheral velocity of the impeller.

By using these definitions and assumptions it will be shown below that a is independant of the flow. The conditions are that the leading edge lies in a plane that is essentially perpendicular to the direction z of the impeller shaft and that the leading edge is located where the absolute inlet velocity is essentially axial, which means that the radial component of $\overline{W}_R$ is near zero. For the same reasons the circumferencial component of $\overline{W}_R$, i. e in θ direction, equals the peripheral velocity of the impeller and is independent of the flow. The axial component of $\overline{W}_R$ gives a neglectable contribution to $\alpha$ as dRz is zero according to the above. This follows from the definition of scalar product. Accordingly the flow dependant variable $\overline{W}_R$ does not influence $\alpha$ in Equation 2, since the numerator as well as the denominator change proportionally.

According to a preferred embodiment of the invention the leading edge of the vane is located in a plane essentially perpendicular to the impeller shaft. With the knowledge that a pump very often operates within a broad field as concerns volume flow and head, the preferred embodiment admits that the self cleaning ability can be kept independant of different operation conditions.

The third part of the invention concerns a preferred embodiment where the connection of the leading edge to the hub is located adjacent the end 8 of the hub 1, i.e. the latter has no central protruding tip. This diminishes the risk for pollutants being wound around the central part of the impeller.

What is claimed is:

1. A pump impeller for one of a centrifugal- and half axial pump, the pump being capable of pumping sewage water, the pump impeller comprising:

a hub; and at least one vane with leading edges which are swept backwards towards a periphery at a sweep angle ($\alpha$), the sweep angle ($\alpha$), defined in every point on the leading edge as the angle between the normal to the leading edge and the projected relative velocity ($W_R$) of a pumped medium at that point, has a value within an area limited by the interval 40–55 degrees at a connection of the leading edge to the hub and 60–75 degrees at a periphery of the leading edge and having a mainly even variation therebetween.

2. A pump impeller according to claim 1, wherein the angle ($\alpha$) between the normal to the leading edge and the projected relative velocity ($W_R$) of the pumped medium at each point on the leading edge, has a value within an area limited by the interval 45–55 degrees at the connection of the leading edge to the hub and 62–72 degrees at the periphery of the leading edge and having a mainly even variation therebetween.

3. A pump impeller according to claim 1, further comprising an impeller shaft (z), wherein the leading edge of the vane is located essentially in a plane perpendicular to the impeller shaft (z) where the absolute velocity of the pumped medium is mainly axial.

4. A pump impeller according to claim 1, wherein the connection of the leading edge to the hub is located adjacent an end of said hub.

* * * * *